US008100522B2

(12) United States Patent
Matsuhashi

(10) Patent No.: US 8,100,522 B2
(45) Date of Patent: Jan. 24, 2012

(54) RECORDING APPARATUS AND RECORDING METHOD OF RECORDING APPARATUS

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 476 days.

(21) Appl. No.: 12/389,084

(22) Filed: Feb. 19, 2009

(65) Prior Publication Data

US 2009/0207225 A1 Aug. 20, 2009

(30) Foreign Application Priority Data

Feb. 20, 2008 (JP) ..... 2008-039047
Nov. 17, 2008 (JP) ..... 2008-293487

(51) Int. Cl.
*B41J 2/01* (2006.01)
*B41J 29/38* (2006.01)

(52) U.S. Cl. ..... 347/102; 347/16; 347/101

(58) Field of Classification Search ..... 347/102, 347/101, 104; 101/488; 219/216; 346/25
See application file for complete search history.

(56) References Cited

U.S. PATENT DOCUMENTS 5,510,822 A * 4/1996 Vincent et al. ..... 347/102
6,328,440 B1 * 12/2001 Medin et al. ..... 347/102
7,771,039 B2 * 8/2010 Sakagami ..... 347/102
2002/0071016 A1 * 6/2002 Wotton et al. ..... 347/102
2003/0081098 A1 * 5/2003 Wotton et al. ..... 347/102
2003/0137573 A1 * 7/2003 Rasmussen et al. ..... 347/104
2004/0016143 A1 * 1/2004 Cleary et al. ..... 34/394
2005/0195264 A1 * 9/2005 Sootome et al. ..... 347/104

FOREIGN PATENT DOCUMENTS

JP 08-132605 5/1996
JP 2004-130705 4/2004
JP 2006-150723 6/2006

* cited by examiner

*Primary Examiner* — Stephen Meier
*Assistant Examiner* — Leonard S Liang
(74) *Attorney, Agent, or Firm* — Workman Nydegger

(57) ABSTRACT

A recording apparatus includes: a supporting member that has a supporting surface for supporting a target to which a liquid is ejected; a heating apparatus that heats the supporting member; a transport unit that transports the target from an upstream side of the supporting member to a downstream side while sliding the target on the supporting surface; and a recording unit that, when a direction in which the target supported on the supporting surface is transported is a main scanning direction, repeatedly performs a moving operation in the main scanning direction in which the liquid is ejected to a recording area of the target to perform recording and a moving operation in a sub-scanning direction in which no liquid is ejected, thereby performing recording on the recording area of the target.

2 Claims, 9 Drawing Sheets

RECORDING APPARATUS AND RECORDING METHOD OF RECORDING APPARATUS

BACKGROUND

1. Technical Field

The present invention relates to a recording apparatus and a recording method of the recording apparatus.

2. Related Art

In general, as a recording apparatus that ejects a liquid to a target to perform recording, an ink jet printer (hereinafter, referred to as a 'printer') has been widely known (for example, JP-A-2006-150723). The printer disclosed in JP-A-2006-150723 includes a platen (supporting member) that supports a continuous sheet (target) and a recording head (liquid ejecting head) that ejects ink (liquid) to the continuous sheet supported on the platen. In addition, a plurality of suction holes for attracting the continuous sheet to the platen and holding it are formed in the platen.

When the continuous sheet is transported from the upstream side of the platen in a transport direction onto the platen, the transport of the continuous sheet stops once, and the continuous sheet is attracted to the platen by the suction holes. In this state, the recording head ejects ink to a printing area of the continuous sheet while being moved above the continuous sheet. Then, when the ejection of ink to the continuous sheet on the platen is completed, the attraction of the continuous sheet to the platen is released, and the continuous sheet is transported to the downstream side of the platen in the transport direction.

In addition, a heating unit (for example, a heater) that heats the platen is provided in the platen. Heat generated by the heating unit is transmitted to the continuous sheet on the platen through the platen. As a result, the continuous sheet is transported to the downstream side of the platen in the transport direction, with ink ejected from the recording head to the continuous sheet being dried a little on the platen.

However, in the printer disclosed in JP-A-2006-150723, as shown in FIGS. 9A to 9C, in a continuous sheet 12 attracted to the platen 27, the temperature T2 of a region C that is disposed on a suction hole 44 (hereinafter, referred to as a 'non-contact region') is lower than the temperature T1 of a region B that directly contacts a heated platen 27 (hereinafter, referred to as a 'contact region') (see FIG. 9A). That is, since a plurality of suction holes 44 are formed in the platen 27 that is heated by a heating unit, there is a temperature difference between a portion in which the suction hole 44 is formed (low temperature region) and a portion in which the suction hole 44 is not formed (high temperature region).

Therefore, in the continuous sheet 12, there is a difference between the temperature T1 of the contact region B that directly contacts the high temperature region of the platen 27 and the temperature T2 of the non-contact region C that is disposed on the low temperature region (suction hole 44) of the platen 27. For this reason, in the continuous sheet 12 disposed on the platen 27, an ink solvent is more actively evaporated from the contact region B having a rear surface directly contacted with the platen 27 than from the non-contact region C having a front surface disposed on the suction hole 44. That is, there is a difference in the dry speed of ink between the contact region B and the non-contact region C.

In particular, in the case of a continuous sheet 12 having low absorptivity, ink in the non-contact region C that is disposed on the suction hole 44 and has a low dry speed flows to the contact region B that is disposed on the platen 27 and has a high dry speed. Therefore, a coloring component, serving as a solute, included in ink, serving as a liquid, also flows to the contact region B that directly contacts the platen 27. Therefore, as shown in FIGS. 9B and 9C, after ink is dried, a coloring component is concentrated on a portion of the surface of the continuous sheet 12 corresponding to the circumference of the suction hole 44. That is, shading occurs between a portion of the surface of the continuous sheet 12 corresponding to the circumference of the suction hole 44 and another portion thereof corresponding to the center of the suction hole 44, which results in a thermal spot. As a result, printing accuracy (image quality) is lowered.

SUMMARY

An advantage of some aspects of the invention is that provides a recording apparatus and a recording method capable of dispersing thermal spots of a target to prevent deterioration of image quality.

According to an aspect of the invention, a recording apparatus includes: a supporting member that has a supporting surface for supporting a target to which a liquid is ejected; a heating apparatus that heats the supporting member; a transport unit that transports the target from an upstream side of the supporting member to a downstream side while sliding the target on the supporting surface; and a recording unit that, when a direction in which the target supported on the supporting surface is transported is a main scanning direction, repeatedly performs a moving operation in the main scanning direction in which the liquid is ejected to a recording area of the target to perform recording and a moving operation in a sub-scanning direction in which no liquid is ejected, thereby performing recording on the recording area of the target. When the supporting member is heated by the heating apparatus, the supporting member includes a high temperature region having a relatively high temperature and a low temperature region having a relatively low temperature in the supporting surface. The transport unit transports the target that is supported on the supporting surface so as to be laid across the high temperature region and the low temperature region at least one time during a period from the start of the ejection of the liquid to the recording area to the end of the ejection of the liquid to the entire recording area by the recording unit. A movement distance of the target transported by one transport operation is smaller than the width of the low temperature region in the transport direction.

According the above-mentioned aspect, the transport unit transports the target from the upstream side in the transport direction onto the supporting surface of the supporting member. Then, the recording unit ejects the liquid to the recording area of the target supported by the supporting surface while being moved in the main scanning direction, which is the transport direction. Then, a large amount of heat is applied from the supporting member to ink droplets ejected to the recording area supported by the high temperature region of the supporting surface, among the ejected liquid droplets. On the other hand, the amount of heat applied to ink droplets ejected to the recording area supported by the low temperature region of the supporting surface is less than that applied to the ink droplets ejected to the recording area supported by the high temperature region. Therefore, when the target stops until the ejection of the liquid to the entire recording area is completed, there is a difference in the dry speed of liquid on the recording area due to a temperature difference between the high temperature region and the low temperature region of the supporting surface supporting the recording area.

However, in the above-mentioned structure, during the period from the start of the ejection of the liquid to the recording area to the end of the ejection of the liquid to the entire recording area, the transport unit transports the target. As a result, in the recording area of the target, the boundary between the regions supported by the high temperature region and the low temperature region of the supporting surface is changed. Therefore, it is possible to disperse the concentration of a solute component in the vicinity of the boundary with the dry of the liquid, in the recording area of the target. That is, since a region having a high dry speed and a region having a low dry speed region are changed in the transported target, the flow of liquid in a direction that is parallel to the supporting surface due to the difference between the dry speeds is also changed.

Since the movement distance of the target during transport is less than the width of the low temperature region in the transport direction, a portion of the region that is supported by the low temperature region and has a low dry speed in the target is supported by the high temperature region. Therefore, while the liquid is ejected to the entire recording area, the partial concentration of a solute component is prevented, and it is possible to shade off the boundary between the liquid droplets ejected to the target supported by the high temperature region and the low temperature region.

The target having the liquid ejected thereto is gradually transported onto the supporting surface by the transport unit while sliding on the supporting surface. The target receives heat from the supporting member and is then dried a little. Then, the target is further transported to the downstream side. Therefore, it is possible to continuously perform the ink ejection and drying operations capable of maintaining good image quality of the target and the transport operation of the target.

The target is supported on the supporting surface of the heated supporting member. Then, the recording unit repeatedly performs a moving operation in the main scanning direction in which the liquid is ejected to the recording area and a moving operation in the sub-scanning direction in which no liquid is ejected, thereby performing recording on the recording area of the target. That is, in the recording apparatus that performs the above-mentioned recording process, a solute component included in the liquid is prevented from partially fixed when the liquid is dried. Therefore, it is possible to prevent deterioration of image quality.

According to another aspect of the invention, a recording method includes: heating a supporting member having a supporting surface which supports a target to which a liquid is ejected while the target is transported from an upstream side to a downstream side in a transport direction and on which the target slides so as to have a high temperature region having a relatively high temperature and a low temperature region having a relatively low temperature in the supporting surface; allowing a recording unit to repeatedly perform a moving operation in a main scanning direction, which is the transport direction, in which the liquid is ejected to a recording area of the target to perform recording and a moving operation in a sub-scanning direction in which no liquid is ejected, with the recording area of the target being supported by the supporting surface so as to be laid across the high temperature region and the low temperature region, thereby performing recording on the recording area of the target; and transporting the target during a period from the start of the ejection of the liquid to the recording area to the end of the ejection of the liquid to the entire recording area.

According to the above-mentioned aspect, a portion of the recording area is supported by the high temperature region, and another portion thereof is supported by the low temperature region. Therefore, when the ejection of liquid by the recording unit is performed over the low temperature region and the high temperature region, different amounts of heat are applied to the liquid in the two regions, and there is a difference in the dry speed of the liquid between the two regions. When there is a difference in the dry speed of the liquid continuously ejected to the surface of the target, the liquid flows from the region having a low dry speed to the region having a high dry speed. That is, a solute component is fixed to a portion of the target in the vicinity of the boundary between the high temperature region and the low temperature region when the liquid is dried. However, the target is transported during the period from the start of the ejection of the liquid to the recording area to the end of the ejection of the liquid to the entire recording area. Therefore, even when the amount of solvent evaporated is increased with the target being supported by the supporting member, the fixing position of a solute component is changed to prevent the partial concentration of the solute component. As a result, it is possible to prevent deterioration of image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an ink jet printer, which is an example of a recording apparatus according to a first embodiment of the invention, will be described with reference to the accompanying drawings. In the following description, an 'up-down direction' and a 'left-right direction' are based on the directions represented by arrows in FIG. 1. In addition, a 'front-rear direction' is orthogonal to the plane of FIG. 1, and is represented by an arrow in FIG. 2.

Figure 1:
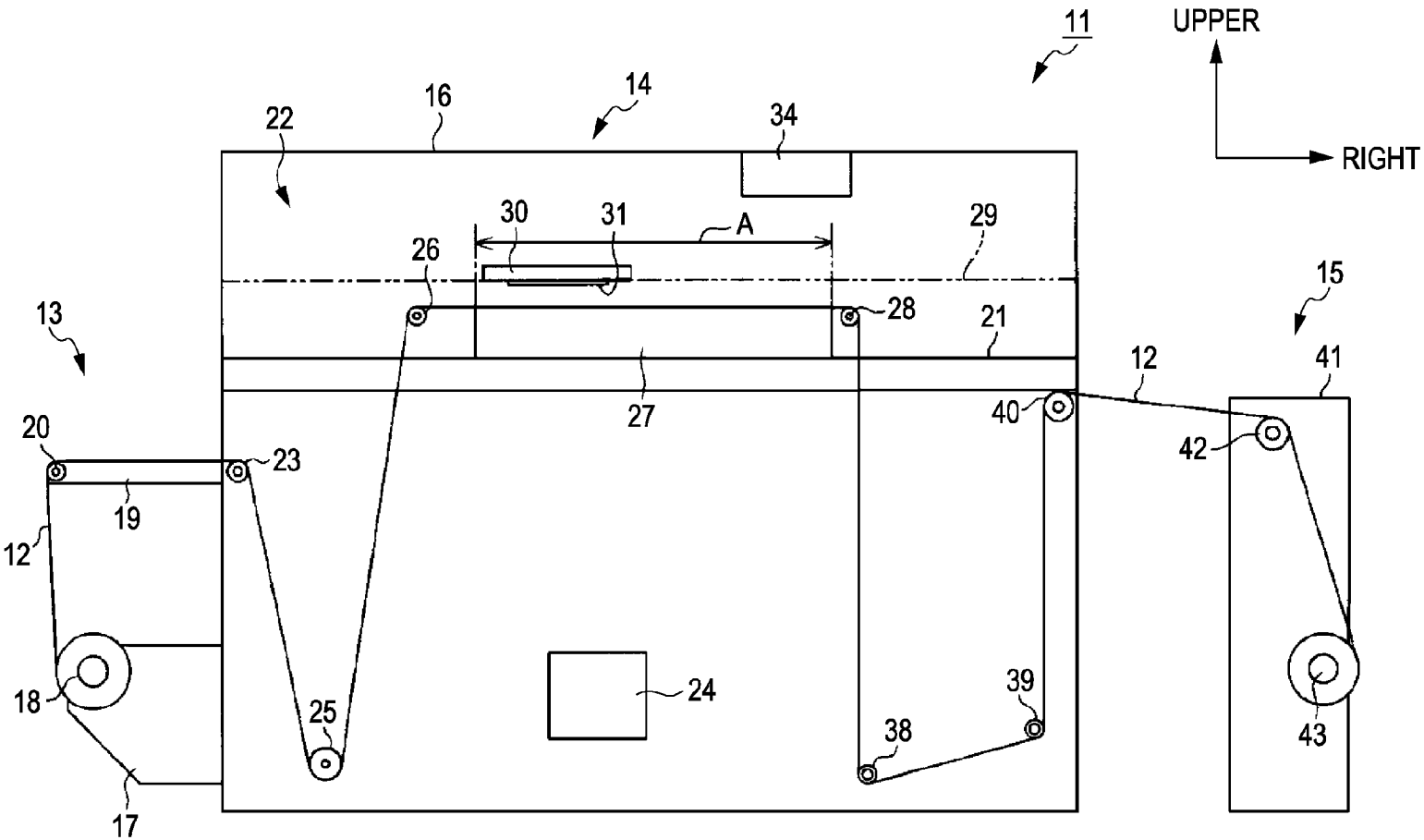
FIG. 1 is a front view schematically illustrating an ink jet printer according to a first embodiment of the invention.

As shown in FIG. 1, an ink jet printer (hereinafter, referred to as a 'printer') 11, serving as a recording apparatus, includes a feed unit 13 that feeds a long continuous sheet 12, which is a target, a main body 14 that sequentially performs printing (recording) on the continuous sheet 12 fed by the feed unit 13, and a winding unit 15 that winds the continuous sheet 12 having images printed by the main body 14. The main body 14 includes a rectangular parallelepiped body case 16. The feed unit 13 is provided on the left side of the body case 16, which is the upstream side in the transport direction of the continuous sheet 12, and the winding unit 15 is provided on the right side of the body case 16, which is the downstream side in the transport direction.

The feed unit 13 includes a supporting plate 17 that extends to the left side from the lower end of a left surface of the body case 16. A winding shaft 18 that extends to the front side (the near side in a direction that is orthogonal to the plane of FIG. 1) is provided at the left end of the supporting plate 17 so as to be rotatably supported by the supporting plate 17. The continuous sheet 12 wound in a roll shape is supported by the winding shaft 18 so as to be rotatable integrally with the winding shaft 18. A sheet that has water repellency or low absorptivity and enables ink (liquid) adhered thereto to be dried in the vicinity of the surface thereof is used as the continuous sheet 12 according to this embodiment.

In addition, the feed unit 13 includes a plate-shaped feed table 19 that extends from the center of the left surface of the body case 16 to the left side in the horizontal direction. A relay roller 20 is rotatably provided at the leading end of the feed table 19 to guide the continuous sheet 12 continuously fed from the winding shaft 18 to the upper surface of the feed table 19. The continuous sheet 12 is transported to the right side (to the main body 14) along the upper surface of the feed table 19.

A plate-shaped base 21 that partitions the inner space of the body case 16 in the vertical direction is provided at a position that is slightly above the center of the body case 16 of the main body 14 in the vertical direction. In addition, a region above the base 21 in the body case 16 serves as a printing chamber 22 where printing is performed on the continuous sheet 12.

A carry-in hole (not shown) through which the continuous sheet 12 is transported from the upper surface of the feed table 19 into the body case 16 is provided in the left wall of the body case 16. A drawing roller 23, serving as a transport unit, is rotatably provided in the main body 14 in the vicinity of the carry-in hole so as to be opposite the carry-in hole. The rotation of the drawing roller 23 is controlled on the basis of control signals of a control device 24 (see FIG. 1), serving as a control unit, provided in a control box (not shown) in the body case 16.

A relay roller 25 is rotatably provided on the lower right side of the drawing roller 23 in the body case 16. The continuous sheet 12 drawn into the body case 16 by the driving of the drawing roller 23 is transported to a position close to the left end of the printing chamber 22 and then wounded on the relay roller 25.

A relay roller 26 is provided on the upper right side of the relay roller 25 in the printing chamber 22. The continuous sheet 12 is wounded on the relay roller 26 from the lower left side, and is then transported to the right side in the horizontal direction.

A platen 27, serving as a rectangular plate-shaped supporting member supported by the base 21, is provided on the right side of the relay roller 26 in the printing chamber 22. A direction changing roller 28 is provided on the right side of the platen 27 so as to be opposite to the relay roller 26 with the platen 27 interposed therebetween. In this case, the upper surface of the relay roller 26, the upper surface of the platen 27, and the upper surface of the direction changing roller 28 are flush with each other.

The continuous sheet 12 transported from the relay roller 26 to the right side along the upper surface of the platen 27 in the horizontal direction is wound on the direction changing roller 28 from the upper left side, and the transport direction of the continuous sheet 12 is changed downward from the horizontal right direction to the vertical direction. The continuous sheet 12 whose transport direction is changed downward in the vertical direction by the direction changing roller 28 is transported in the vertical direction through a through hole (not shown) provided in the base 21.

A pair of guide rails 29 (which are represented by a two-dot chain line in FIG. 1) are provided at the front and rear sides of the platen 27 in the printing chamber 22 so as to extend in the left-right direction, which is a main scanning direction. The upper surfaces of the guide rails 29 are higher than that of the platen 27. A rectangular plate-shaped carriage 30 is supported by the upper surfaces of the guide rails 29 such that it can be reciprocated in the left-right direction along the guide rails 29. The carriage 30 is moved in the left-right direction along the guide rails 29 on the basis of the control signal of the control device 24.

A slide plate (not shown) is supported on the lower surface of the carriage 30 such that it can slide relative to the carriage 30 in the front-rear direction, which is sub-scanning direction. A recording head 31, serving as a recording unit, is supported on the lower surface of the slide plate.

Valve units 34 that temporarily store ink are provided on the upper wall of the body case 16 in the printing chamber 22. The valve units 34 temporarily store different color inks.

The valve units 34 are connected to the recording head 31 through corresponding ink supply tubes (not shown), and the color inks are supplied to the recording head 31 through the ink supply tubes. In addition, a plurality of nozzles (not shown) are provided in a lower surface of the recording head 31. In the printer 11, ink supplied from the valve units 34 is ejected from the nozzles to the continuous sheet 12 which has been transported and placed on the platen 27, on the basis of the control signal of the control device 24. In this way, printing is performed on the continuous sheet 12.

A region of the continuous sheet 12 that is supported by the upper surface (supporting surface) of the platen 27 during printing is a printing area A serving as a recording area. The continuous sheet 12 is intermittently transported from the upstream side to the downstream side of a transport path of the continuous sheet 12 in the unit of the printing area A. The recording head 31 ejects ink to the printing area A of the continuous sheet 12 while being moved in the left-right direction with the movement of the carriage 30 in the left-right direction. In addition, the recording head 31 is displaced in the front-rear direction by the slide plate to change its movement path, and ejects ink to the entire printing area A.

As shown in FIG. 1, the continuous sheet 12 transported downward in the vertical direction by the direction changing roller 28 is wound on a reversing roller 38, which is rotatably provided immediately below the direction changing roller 28 in the body case 16, from the upper left side. Then, the continuous sheet 12 is transported in a direction that is slightly inclined toward the upper right side. In addition, the continuous sheet 12 transported from the reversing roller 38 is wound on a relay roller 39, which is rotatably provided on the right side of the reversing roller 38 in the body case 16, from the lower left side. Then, the continuous sheet 12 is transported upward in the body case 16 along the upper wall of the body case 16. The continuous sheet 12 with the printing area A having an image printed thereon is naturally dried on the transport path in the body case 16.

A carry-out hole (not shown) through which the continuous sheet 12 is carried out to the winding unit 15 is provided in the right wall of the body case 16 in the vicinity of the base 21. A carrying-out roller 40, serving as a transport unit, is rotatably provided in the body case 16 in the vicinity of the carry-out hole so as to be opposite to the carry-out hole. When the carrying-out roller 40 is driven on the basis of the control signal of the control device 24, the continuous sheet 12 is carried out to the winding unit 15 through the carry-out hole.

The winding unit 15 includes a rectangular parallelepiped winding frame 41. The height of the winding frame 41 is substantially equal to that of the carrying-out roller 40. In addition, a relay roller 42 is rotatably provided at the upper end of the winding frame 41. Therefore, the continuous sheet 12 carried out through the carry-out hole is wound on the relay roller 42 from the upper left side and then transported toward the lower right side.

A winding shaft 43, serving as a transport unit, that extends to the front side is provided on the lower right side of the relay roller 42 in the winding frame 41 so as to be rotatably supported by the winding frame 41. The continuous sheet 12 transported from the relay roller 42 to the lower right side is wound on the winding shaft 43. When the winding shaft 43 is rotated on the basis of the control signal of the control device 24, the continuous sheet 12 is sequentially wound on the winding shaft 43.

Next, the structure of the platen 27 will be described with reference to FIG. 2.

Figure 2:
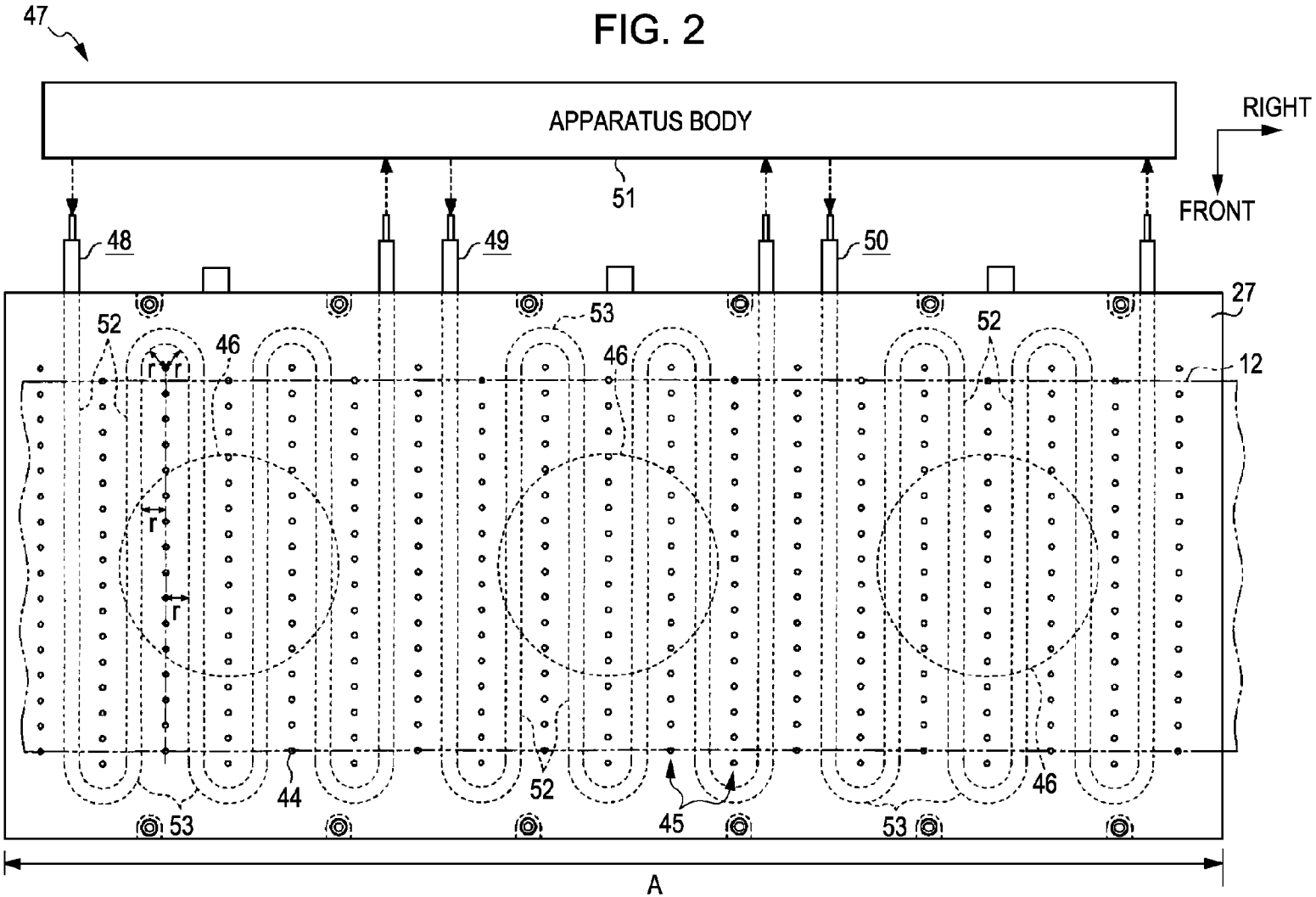
FIG. 2 is a plan view illustrating a platen of the printer.

As shown in FIG. 2, a plurality of suction holes 44 are formed in the platen 27 so as to pass thorough the platen 27 in the vertical direction (in the thickness direction of the platen 27). That is, the suction holes 44 are formed so as to pass through the upper surface (supporting surface) and the lower surface (a surface opposite to the supporting surface) of the platen 27. The diameters of the holes in the upper and lower surfaces are equal to each other.

The suction holes 44 are regularly arranged such that a plurality of suction hole columns 45 (19 suction hole columns in FIG. 2), each having a plurality of suction holes 44 (16 suction holes in FIG. 2) arranged in the front-rear direction, are provided at predetermined intervals in the left-right direction. In addition, fans 46, serving as suction units that draw air in the suction holes 44, are provided below the platen 27 (that is, between a region between the platen 27 and the base 21). Each of the fans 46 is driven on the basis of the control signal of the control device 24 to generate a negative pressure in the suction hole 44. The negative pressure causes the continuous sheet 12 to be attracted to the upper surface of the platen 27 through the suction holes 44.

Next, a heating apparatus that heats the platen 27 will be described with reference to FIG. 2.

As shown in FIG. 2, a heating apparatus 47 includes a plurality of heaters 48, 49, and 50 (three heaters in this embodiment) buried in the platen 27 and an apparatus body 51 that supplies a current to each of the heaters 48, 49, and 50 to generate heat. The heaters 48, 49, and 50 are arranged in a line in the left-right direction in the platen 27 (that is, at different positions in the left-right direction). The heaters 48, 49, and 50 are individually supplied with a current from the apparatus body 51 to generate heat. Heat generated from each of the heaters 48, 49, and 50 is transmitted to the continuous sheet 12 on the platen 27 through the platen 27.

Each of the heaters 48, 49, and 50 is formed by bending a long member at a plurality of portions. That is, each of the heaters 48, 49, and 50 includes a plurality of first heating portions 52 (six first heating portions in this embodiment) that extend in the front-rear direction and are arranged between the suction hole columns 45 adjacent to each other in the left-right direction, and a plurality of second heating portions 53 (five second heating portions in this embodiment) each of which connects the first heating portions 52 arranged in the left-right direction with one suction hole column 45 interposed therebetween.

Each of the first heating portions 52 is formed such that the length thereof in the front-rear direction is larger than that of the suction hole column 45 in the front-rear direction. In addition, the first heating portions 52 are arranged at the center between the leftmost and rightmost suction hole columns 45 in the left-right direction. Therefore, the distances between the first heating portion 52 and the suction hole columns 45 adjacent to the first heating portion 52 in the left-right direction are 'r'.

Each of the second heating portions 53 is formed in an arc shape that has as its center the suction hole 44 that is positioned at the end of the suction hole column 45 in the front-rear direction (that is, in the direction in which the suction hole column 45 extends) among the suction hole columns 45 that are disposed at the same position in the front-rear direction. That is, among the second heating portions 53, the second heating portions 53 in front of the suction hole columns 45 are each formed in an arc shape with a curvature radius of r that has as its center the suction hole 44 disposed at the leading end of the suction hole column 45. In addition, among the second heating portions 53, the second heating portions 53 disposed at the rear sides of the suction hole columns 45 are each formed in an arc shape with a curvature radius of r that has as its center the suction hole 44 disposed at the rear end of the suction hole column 45.

Therefore, in the platen 27, there is a difference between the temperature of a region in which the suction holes 44 are formed (hereinafter, referred to as a 'low temperature region') and the temperature of a region in which the suction hole 44 is not formed (hereinafter, referred to as a 'high temperature region'). For this reason, in the continuous sheet 12 supported on the platen 27, the temperature of a contact region B that directly contacts the high temperature region of the platen 27 and then heated is higher than that of a non-contact region C that is disposed on the low temperature region (that is, the suction holes 44) of the platen 27 (see FIG. 3).

Next, the operation of the printer 11 according to the first embodiment will be described. For example, the operation of the printer 11 ejecting ink to the printing area A of the continuous sheet 12 transported onto the platen 27 heated by the heating apparatus 47 to perform, for example, solid printing will be described. The continuous sheet 12 is arranged on the platen 27 such that both ends (both edges) thereof in the front-rear direction are disposed inside the second heating portions 53 of the heaters 48, 49, and 50.

When the printer 11 starts printing on the continuous sheet 12, the control device 24 operates the drawing roller 23, the carrying-out roller 40, and the winding shaft 43. That is, the control device 24 transports the continuous sheet 12 from the upstream side to the downstream side while sliding the continuous sheet on the upper surface of the platen 27, and stops the continuous sheet 12 such that the printing area A is disposed on the platen 27. In this case, the drawing roller 23, the carrying-out roller 40, and the winding shaft 43 serve as a transport unit.

In addition, the control device 24 operates the fans 46 provided below the platen 27 to draw air in the suction holes 44. Then, a portion of the continuous sheet 12 supported by the platen 27 (which is represented by a two-dot chain line in FIG. 2) is attracted to the upper surface of the platen 27. When the apparatus body 51 operates the heaters 48, 49, and 50 to generate heat, the heat generated by the heaters 48, 49, and 50 is transmitted to the contact region B in the printing area A of the continuous sheet 12 through the platen 27.

In this state, the control device 24 moves the carriage 30 from the right rear position of the printing area A to the left side (in the main scanning direction) and controls the recording head 31 moved together with the carriage 30 to eject ink to the continuous sheet 12. In this case, a printing start position where the recording head 31 starts ejecting ink leans to the left side from the right end of the printing area A. When the carriage 30 is moved to the left side along the guide rails 29 and reaches the left end of the printing area A, the control device 24 stops the ejection of ink from the recording head 31 once. At the left end of the printing area A, the control device moves the slide plate (not shown) forward (in the sub-scanning direction) by a distance corresponding to the width of the region having ink ejected by the recording head 31 in the front-rear direction while the recording head is moved to the left end of the printing area.

Figure 3A:
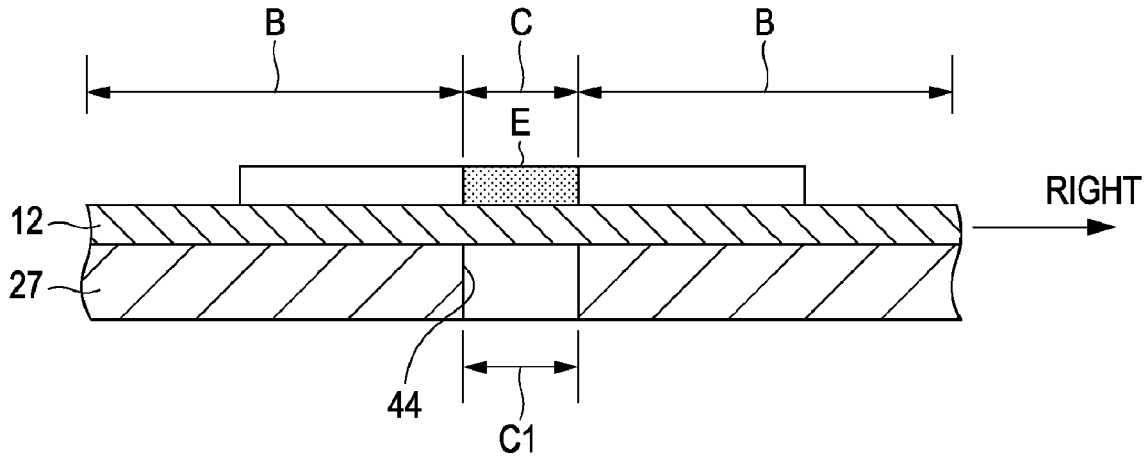
FIG. 3A is a cross-sectional view illustrating the vicinity of a suction hole of the platen supporting a continuous sheet taken along the left-right direction.
Figure 3B:
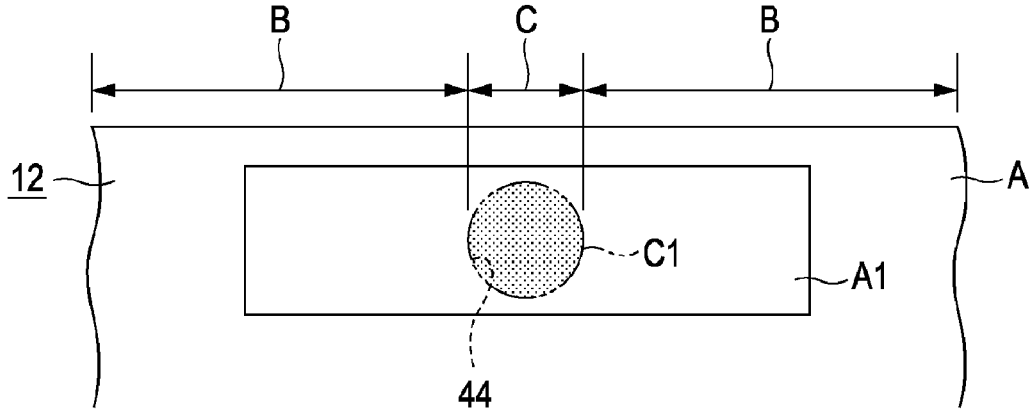
FIG. 3B is a plan view of FIG. 3A.

In this case, as shown in FIGS. 3A and 3B, ink is ejected all over the printing area A of the continuous sheet 12 on both the low temperature region (the suction holes 44) and the high temperature region (the upper surface of the platen 27) of the platen 27, thereby forming a solid printing area A1. However, there is a temperature difference between portions (the contact region B and the non-contact region C) of the solid printing area A1. Therefore, the evaporation speed of an ink solvent (for example, water or an organic solvent) of the ink ejected onto the continuous sheet 12 depends on the position where ink is ejected to the solid printing area A1 (the contact region B or the non-contact region C). That is, when a portion of the solid printing area A1 disposed on the low temperature region of the platen 27 onto which ink is ejected is referred to as an initial non-contact region C1, the dry speed of ink E ejected to the initial non-contact region C1 is low. Therefore, ink flows from the center to the circumference of the initial non-contact region C1.

However, when the control device 24 stops the ejection of ink from the recording head 31 once, the air drawing operation of the fans 46 stops, and the drawing roller 23, the carrying-out roller 40, and the winding shaft 43 are driven. That is, the control device 24 moves the continuous sheet 12 by a movement distance D, which is a relative movement distance to the platen 27, to the downstream side (the right side) in the transport direction. The platen 27 is kept fixed. That is, the continuous sheet 12 is moved the movement distance D to the downstream side along the upper surface (supporting surface) of the fixed platen 27.

Figure 4A:
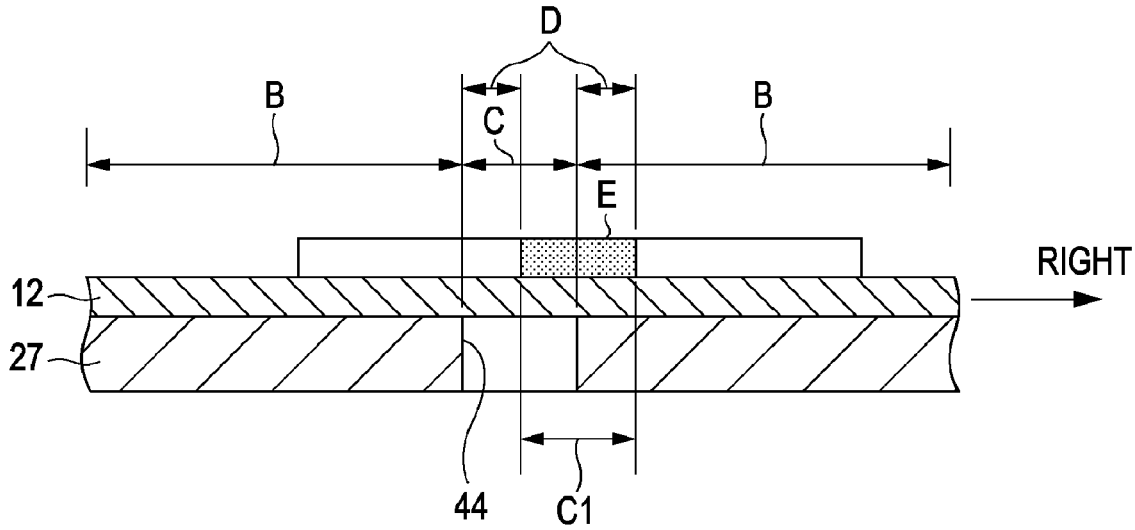
FIG. 4A is a cross-sectional view illustrating the platen and the continuous sheet after printing is further advanced from the state shown in FIG. 3A.
Figure 4B:
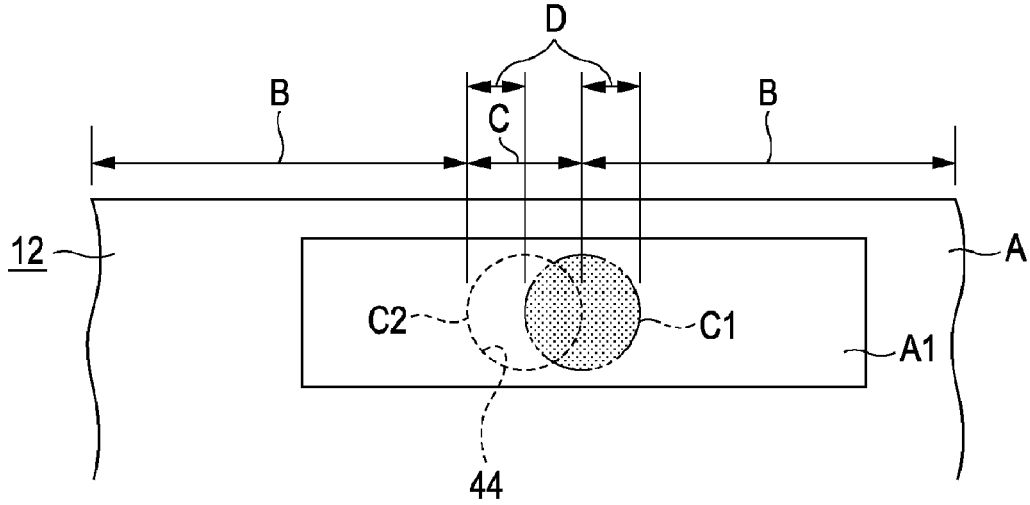
FIG. 4B is a plan view of FIG. 4A.

When the continuous sheet 12 is moved relative to the platen 27, as shown in FIGS. 4A and 4B, a portion of the initial non-contact region C1 on the downstream side (the right side) that is disposed on the suction hole 44 (that is, the low temperature region) is moved to be disposed on the platen 27 (that is, the high temperature region) and becomes a new contact region B. Then, a portion of the contact region B having the same area as the new contact region B on the downstream side of the suction hole 44 is moved the movement distance D on the suction hole 44 from the upstream side of the suction hole 44 to the downstream side, and becomes a portion of a new non-contact region C2.

Therefore, the flow of the ink E from the initial non-contact region C1 having a low dry speed to the contact region B having a high dry speed is changed to correspond to the non-contact region C2 newly disposed in the low temperature region. Therefore, it is possible to prevent the flow of the ink E and the partial concentration of a coloring component (for example, pigment or dye) in the ink E.

Before and after the continuous sheet 12 is moved relative to the platen 27, the area of the non-contact regions C1 and C2 disposed in the low temperature region in the continuous sheet 12 is larger than that of the low temperature region (the area of the upper side of the suction hole 44). Therefore, the amount of heat per unit area applied to the non-contact region C and the contact region B disposed around the non-contact region C is averaged, and the partial concentration of the coloring component is dispersed.

The movement distance D is less than the diameter of the suction hole 44 (that is, the width of the low temperature region), which is the low temperature region, in the transport direction. When printing is performed on the entire printing area A, the sum of the movement distances D is less than the distance between the printing start position where ink is ejected to the printing area A and the downstream end (the right end) of the printing area A. In this embodiment, the movement distance D is equal to the radius of the suction hole 44 in the transport direction.

After the continuous sheet 12 is moved, that is, after the continuous sheet 12 is moved relative to the platen 27, the control device 24 operates the fans 46. In addition, the control device 24 moves the carriage 30 to the downstream side (the right side) in the transport direction by the movement distance D, similar to the continuous sheet 12, and then controls the recording head 31 to eject ink at that position. Then, the control device 24 moves the carriage 30 to the right side (in the main scanning direction) along the guide rails 29. When the carriage is moved up to a position corresponding to the printing start position in the front-rear direction, the control device stops the ejection of ink once, and stops the operation of the fans 46.

Figure 5A:
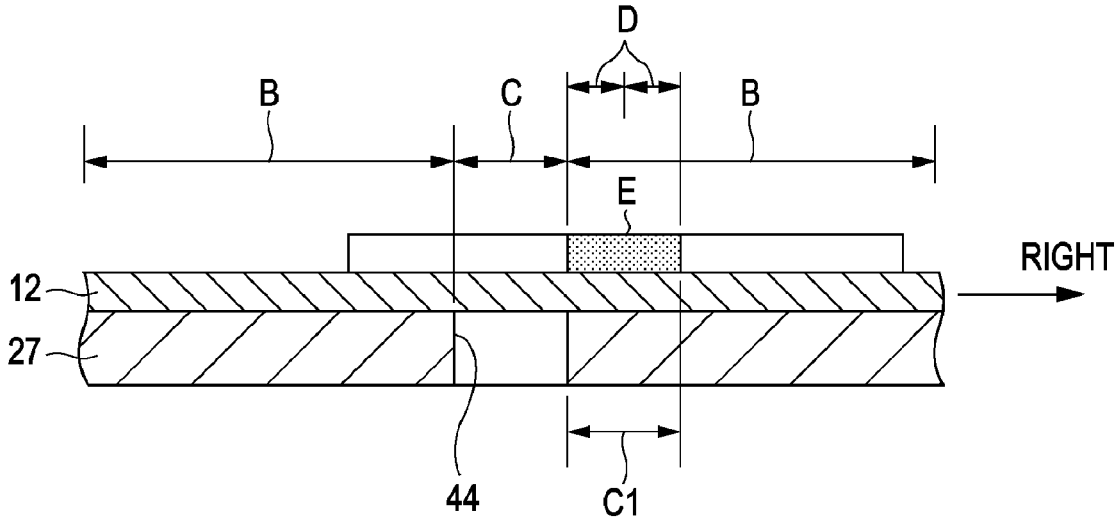
FIG. 5A is a cross-sectional view illustrating the platen and the continuous sheet after printing is further advanced from the state shown in FIG. 4A.
Figure 5B:
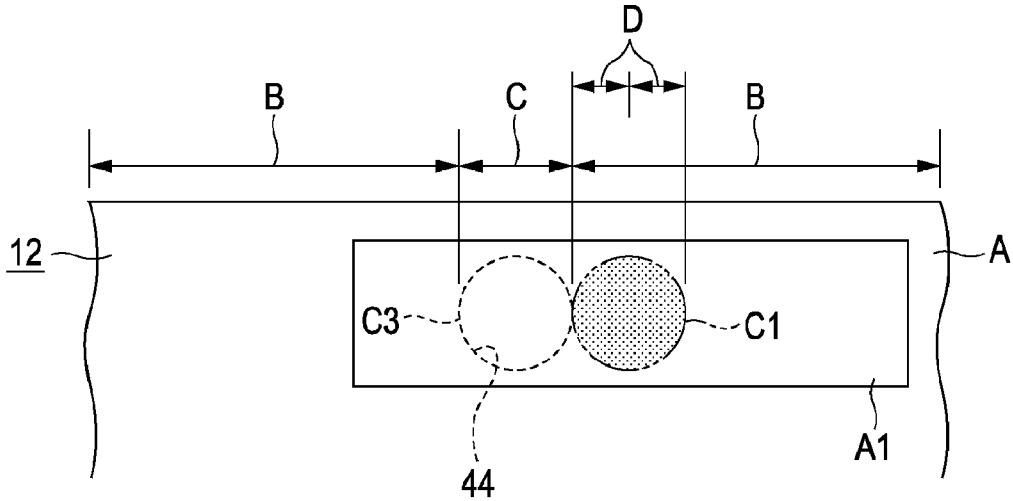
FIG. 5B is a plan view of FIG. 5A.

Then, the control device 24 operates the drawing roller 23, the carrying-out roller 40, and the winding shaft 43. That is, the control device 24 moves the continuous sheet 12 to the downstream side (the right side) in the transport direction by the movement distance D, relative to the platen 27. In this way, as shown in FIGS. 5A and 5B, the entire initial non-contact region C1 is disposed on the platen 27 (high temperature region) and becomes the contact region B. Then, the contact region B is moved from the upstream side to the downstream side to be disposed on the low temperature region, and becomes a new non-contact region C3. Therefore, the ink E is dried by heat generated from the platen 27, and the partial concentration of a coloring component is prevented.

In this case, the control device 24 moves the carriage 30 to the downstream side in the transport direction by a distance that is more than the movement distance D, and then moves it to the front side by a distance corresponding to the width of the region having ink ejected thereto while the carriage is moved to the right side. Then, the control device 24 operates the fans 46 and moves the carriage 30 from a position corresponding to the printing start position in the front-rear direction to the left side while the recording head ejects ink. Therefore, the recording head 31 repeatedly performs reciprocation in the front-rear direction and movement in the forward direction to print images on the entire printing area A while the continuous sheet 12 is moved relative to the platen 27.

Then, when printing on the entire printing area A is completed, the control device 24 stops the operation of the fans 46, and releases the attraction of the continuous sheet 12 to the platen 27. In addition, the control device 24 operates the drawing roller 23, the carrying-out roller 40, and the winding shaft 43 to transport the continuous sheet 12 to the winding unit 15.

According to the first embodiment, it is possible to obtain the following effects.

(1) A large amount of heat is applied from the platen 27 to ink droplets on the contact region B supported by the high temperature region, among the ink droplets ejected to the printing area A of the continuous sheet 12 supported on the upper surface of the platen 27. On the other hand, heat that is less than that applied to the contact region B supported by the high temperature region is applied to ink droplets on the non-contact region C disposed on the low temperature region. Therefore, there is a difference in the dry speed of ink in the continuous sheet 12 due to a temperature difference between the high temperature region and the low temperature region. However, in this embodiment, during the period from the start of the ejection of ink to the printing area A to the end of the ejection of ink to the entire printing area A, the continuous sheet 12 is moved relative to the platen 27. As a result, the boundary between the regions of the continuous sheet 12 supported by the high temperature region and the low temperature region is changed, and it is possible to disperse the partial concentration of a coloring component in the vicinity of the boundary with the dry of ink. In addition, since the contact region B having a high dry speed and the non-contact region C having a low dry speed are changed in the continuous sheet 12 by the relative movement, the flow direction of ink that is parallel to the upper surface is also changed due to the difference between the dry speeds. Therefore, in the printer 11 in which the recording head 31 is repeatedly moved in the left-right direction and the front-rear direction to perform printing, the time for which the continuous sheet 12 is supported by the upper surface of the platen 27 is increased, and the amount of ink solvent evaporated is increased. However, in the printer 11, it is also possible to prevent the coloring component included in ink from being partially fixed to the continuous sheet 12 with the dry of ink. Therefore, it is possible to prevent deterioration of image quality.

(2) Until ink is completely ejected to the entire printing area A, the printing area A to which ink is ejected is not out of the upper surface of the platen 27. Therefore, it is possible to ensure the flatness of the continuous sheet 12 and stably eject ink. In addition, even when ink is sequentially ejected to regions of the printing area A, each having a width that is smaller than that of the printing area A, it is possible to eject ink to the entire printing area A regardless of the order in which ink is ejected to the regions.

(3) When the drawing roller 23, the carrying-out roller 40, and the winding shaft 43 are driven, a portion of the non-contact region C having a low dry speed, which is supported by the low temperature region, in the continuous sheet 12 is moved and supported by the high temperature region. Therefore, while a liquid is ejected to the printing area A, the partial concentration of a coloring component is prevented, and it is possible to shade off the boundary between the ink droplets ejected to the continuous sheet 12 supported by the high temperature region and the low temperature region.

(4) The continuous sheet 12 is supported by the platen 27 so as to be attracted thereto. Therefore, the flatness of the printing area A is improved, and the printing area is contacted with the platen 27 such that heat is effectively transmitted to the printing area. Among the ink droplets ejected to the continuous sheet 12 supported by the upper surface of the platen 27, ink droplets in the contact region B of the continuous sheet 12 that directly contacts the high temperature region are heated by the heating apparatus 47 through the platen 27. On the other hand, ink droplets in the non-contact region C of the continuous sheet 12 that corresponds to the suction hole 44, which is the low temperature region, do not receive heat from the heating apparatus 47, and have a low temperature. Therefore, ink flows from the center of the non-contact region C to the circumference thereof in a direction that is parallel to the upper surface due to a difference in the dry speed of ink between the contact region B and the non-contact region C. Therefore, the continuous sheet 12 is moved relative to the platen 27 such that a portion of the non-contact region C is disposed on the high temperature region. That is, when a portion of the contact region B is disposed on the low temperature region, the flow of ink is changed such that ink flows to the circumference of the non-contact region C that has been newly disposed on the suction hole 44 after the relative movement. Therefore, the time for which each region of the printing area A are disposed on the suction holes 44 and becomes the non-contact region C is shortened, and the degree of dry in the circumference of the non-contact region C is reduced. Therefore, it is possible to disperse the partial concentration of a coloring component in the region of the continuous sheet 12 that is disposed on the suction hole 44 and becomes the non-contact region C during the period from the start of the ejection of ink to the printing area A to the end of the ejection of ink.

(5) When ink is ejected, the printing area A of the continuous sheet 12 is attracted and supported by the upper surface of the platen 27. When the continuous sheet 12 is moved relative to the platen 27, the operation of the fans 46 stops. In this way, it is possible to effectively move the continuous sheet 12 to the downstream side without considering the suction power of the fans 46.

(6) The continuous sheet 12 is transported from the upstream side to the upper surface of the platen 27 by the drawing roller 23, the carrying-out roller 40, and the winding shaft 43. When ink is ejected to the continuous sheet 12 supported on the upper surface of the platen 27, the ink receives heat from the platen 27 that is moved relative to the continuous sheet 12 and is then dried. Then, the continuous sheet 12 is further transported to the downstream side. Therefore, it is possible to continuously perform the ink ejection and drying operations capable of maintaining good image quality of the ink continuous sheet 12 and the transport operation of the continuous sheet 12.

(7) During the period from the start of the ejection of ink to the printing area A to the end of the ejection of ink to the entire printing area A, the drawing roller 23, the carrying-out roller 40, and the winding shaft 43 are driven. In this way, it is possible to move the continuous sheet 12 relative to the platen 27. Therefore, it is not necessary to provide a separate unit that moves the continuous sheet 12 relative to the platen 27. As a result, it is possible to reduce the size of an apparatus including the platen 27, the heating apparatus 47, the drawing roller 23, the carrying-out roller 40, the winding shaft 43, and the control device 24.

Second Embodiment

Next, a second embodiment of the invention will be described with reference to FIG. 2 and FIGS. 6 to 8. The second embodiment is similar to the first embodiment except that the platen 27 is moved relative to the continuous sheet 12. In the second embodiment, the same components as those in the first embodiment are denoted by the same reference numerals, and a detailed description thereof will be omitted.

As shown in FIG. 2, the width of the platen 27 in a direction that is orthogonal to the transport direction of the continuous sheet 12 is larger than that of the continuous sheet 12, and the suction holes 44 and the heaters 48, 49, and 50 are formed in a range that is greater than the width of the continuous sheet 12.

The heaters 48, 49, and 50 buried in the platen 27 are connected to the apparatus body 51 through flexible wiring lines. The platen 27 is configured so as to be reciprocated in the front-rear direction by the driving of a motor included in a platen moving mechanism (moving unit) (not shown). The rotation of the motor of the platen moving mechanism is controlled by driving signals of the control device 24. When the motor is rotated forward, the platen 27 is moved to the front side. On the other hand, when the motor is rotated backward, the platen 27 is moved to the rear side. That is, the platen 27 is moved in the horizontal direction (a direction that is parallel to the upper surface).

In the second embodiment, the drawing roller 23, the carrying-out roller 40, and the winding shaft 43 serve as only the transport unit.

Next, the operation of the printer 11 according to the second embodiment when performing printing on the printing area A of the continuous sheet 12 that is transported from the upstream side of the platen 27 to the downstream side and then supported on the platen 27 will be described.

When printing is performed on the continuous sheet 12 transported onto the platen 27, the control device 24 rotates the motor of the platen moving mechanism backward to dispose the platen 27 at an initial position. In addition, the control device 24 operates the fans 46 to attract the printing area A to the upper surface of the platen 27.

In this state, the carriage 30 is moved from the rear side of the right end of the printing area A to the left side, and the recording head 31 moved together with the carriage 30 ejects ink to the continuous sheet 12. When the carriage 30 is moved to the left side along the guide rails 29 and reaches the left end of the printing area A, the ejection of ink from the recording head 31 stops once. Then, the carriage 30 slides the slide plate (not shown) to the front side by a distance corresponding to the width of a region having ink ejected thereto in the front-rear direction while being moved to the left side, at the left end of the printing area A.

Figure 6A:
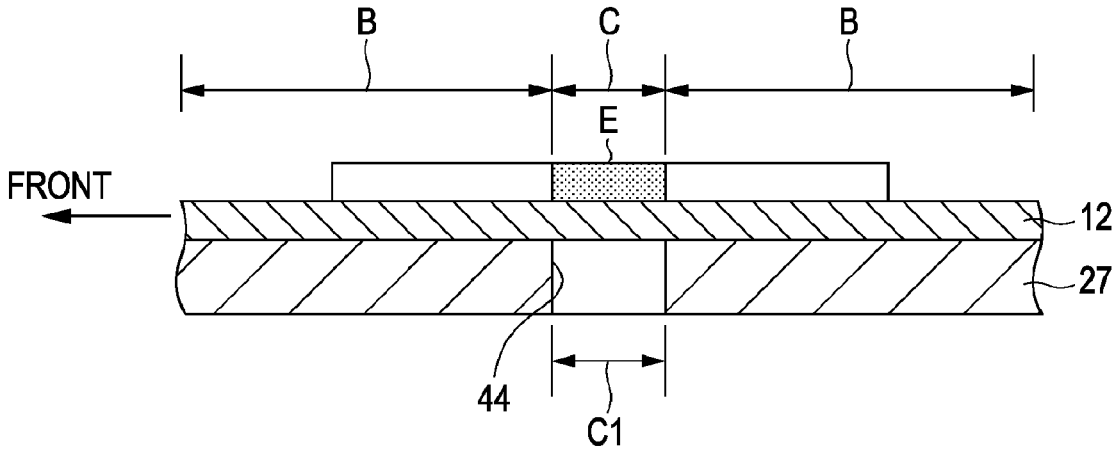
FIG. 6A is a cross-sectional view illustrating the vicinity of the suction hole of the platen supporting the continuous sheet taken along the front-rear direction.
Figure 6B:
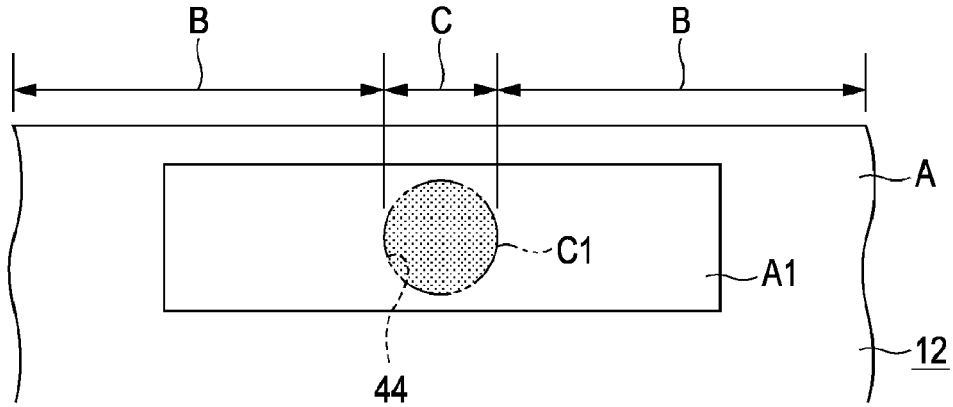
FIG. 6B is a plan view of FIG. 6A.

In this case, as shown in FIGS. 6A and 6B, in a solid printing area A1 in the printing area A of the continuous sheet 12, a portion that directly contacts the high temperature region of the platen 27 is a contact region B, and a portion that is disposed on the suction hole 44, which is the low temperature region, is an initial non-contact region C1. The amount of heat applied to the ink E ejected to the initial non-contact region C1 is less than that applied to ink ejected to the contact region B.

Figure 7A:
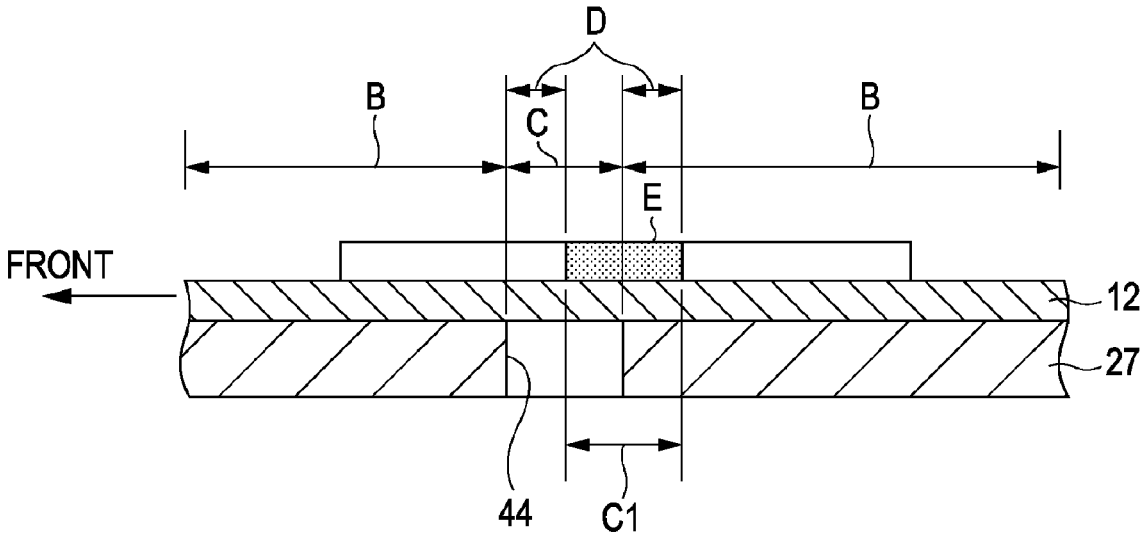
FIG. 7A is a cross-sectional view illustrating the platen and the continuous sheet after printing is further advanced from the state shown in FIG. 6A.
Figure 7B:
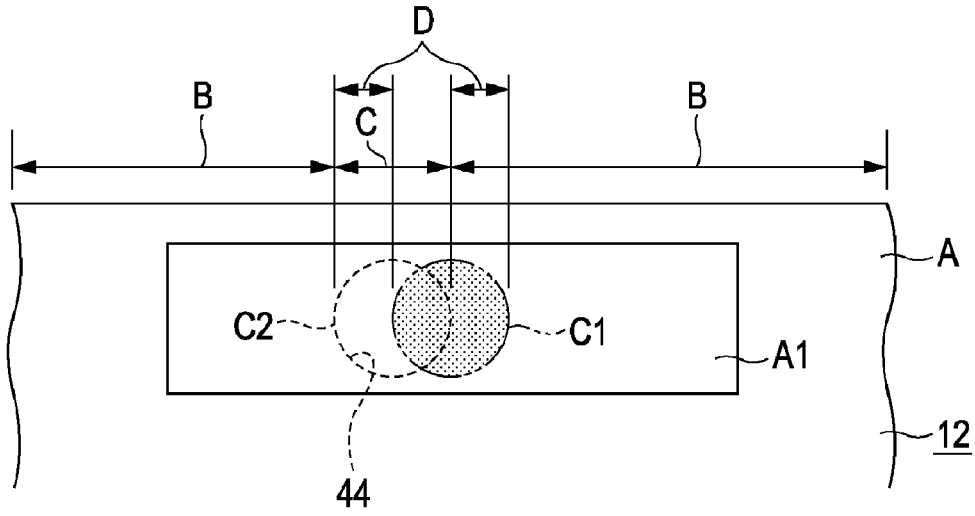
FIG. 7B is a plan view of FIG. 7A.

The control device 24 stops the operation of the fans 46 and releases the attraction of the continuous sheet 12 to the platen 27. In addition, the control device 24 rotates the motor forward to move the platen 27 to the front side in the front-rear direction (relative movement direction) by the movement distance D, relative to the continuous sheet 12. Then, as shown in FIGS. 7A and 7B, a rear portion of the initial non-contact region C1 is disposed on the platen 27 (high temperature region) and becomes the contact region B. On the front side of the initial non-contact region C1, the contact region B is disposed on the suction hole 44 (low temperature region) and becomes a portion of the non-contact region C2.

The movement distance D is set such that the sum of the movement distances D when printing is performed on the entire printing area A is less than the distance between the rear end of the platen 27 disposed at the initial position and the rear end of the continuous sheet 12.

After the platen 27 is moved, that is, after the platen 27 is moved relative to the continuous sheet 12, the control device 24 operates the fans 46. In addition, the control device controls the recording head 31 to eject ink to the printing area A attracted to the platen 27 while moving the carriage 30 to the right side along the guide rails 29. When the carriage is moved up to the right end of the printing area A, the control device stops the ejection of ink from the recording head 31 once.

Figure 8A:
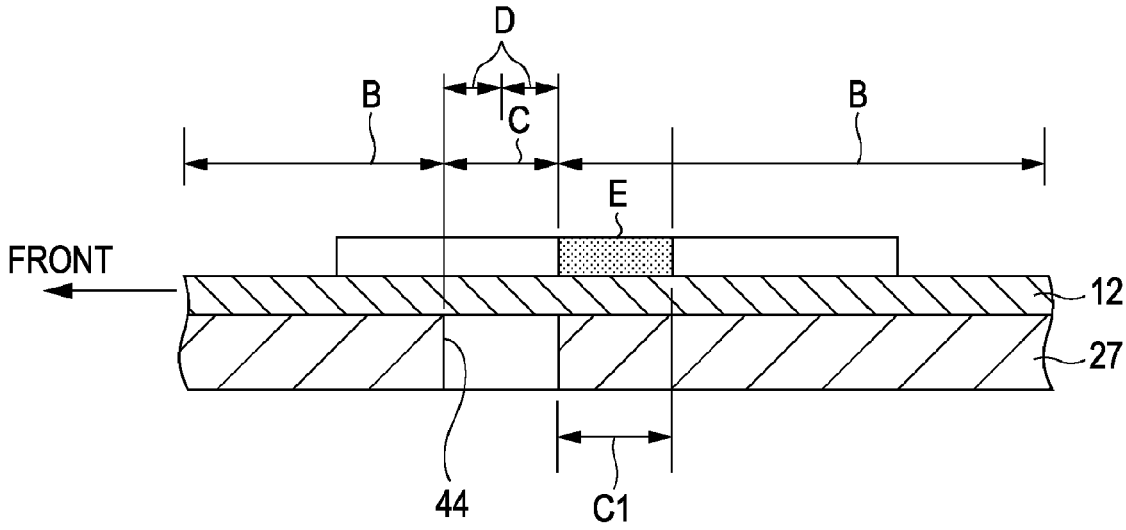
FIG. 8A is a cross-sectional view illustrating the platen and the continuous sheet after printing is further advanced from the state shown in FIG. 7A.
Figure 8B:
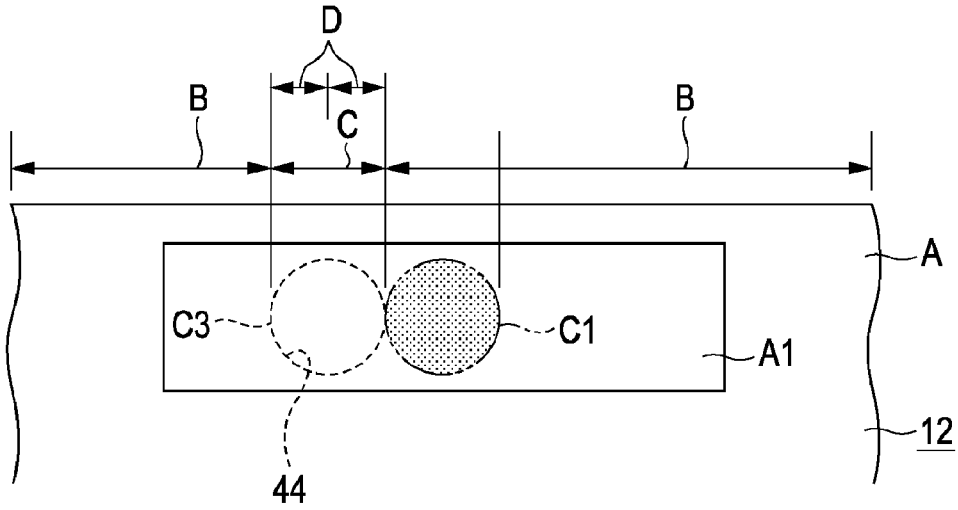
FIG. 8B is a plan view of FIG. 8A.
Figure 9A:
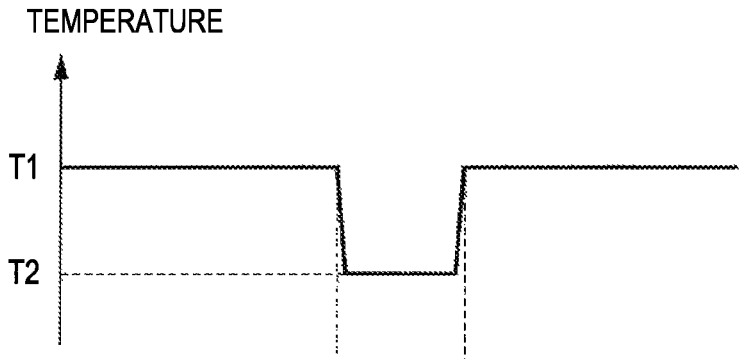
FIG. 9A (Prior Art)
FIG. 9A is a temperature graph when a printer according to the related art performs printing.
Figure 9B:
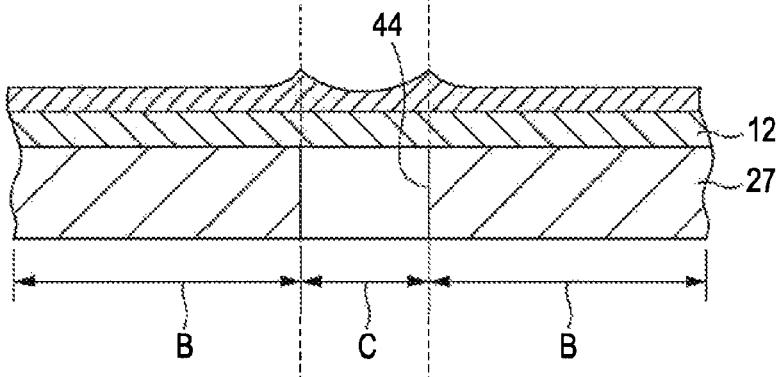
FIG. 9B (Prior Art)
FIG. 9B is a diagram illustrating a printing state.
Figure 9C:
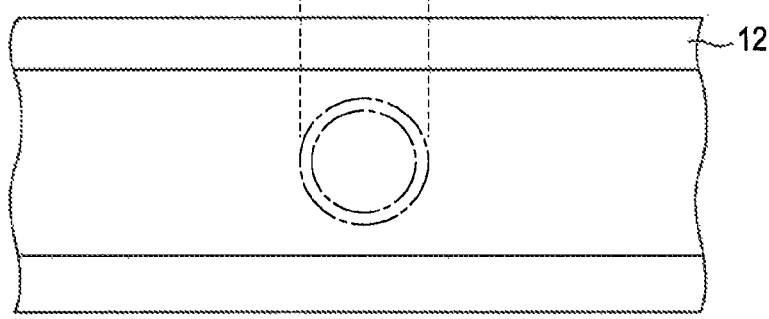
FIG. 9C (Prior Art)
FIG. 9C is a plan view illustrating a continuous sheet after ink is dried.

Then, the control device 24 rotates the motor forward to move the platen 27 to the front side by the movement distance D. In this way, as shown in FIGS. 8A and 8B, the entire initial non-contact region C1 is disposed on the platen 27 and becomes the contact region B. In addition, the contact region B is disposed on the low temperature region, and becomes a new non-contact region C3.

Then, the control device moves the carriage to the front side by a distance corresponding to the width of a region having ink ejected thereto in the front-rear direction, and operates the fans 46. Then, similarly, the control device moves the carriage 30 to the left side. Then, the control device moves the platen 27 relative to the continuous sheet 12 while the carriage 30 repeatedly performs reciprocation in the left-right direction and movement in the front side to perform printing on the entire printing area A.

When printing is completely performed on the entire printing area A, the control device 24 stops the operation of the fans 46. In addition, the control device 24 rotates the motor backward, and the platen 27 is moved to the rear side and disposed at the initial position. The drawing roller 23, the carrying-out roller 40, and the winding shaft 43 are driven to transport the continuous sheet 12 to the downstream side in the transport direction.

According to the second embodiment, it is possible to obtain the following effects in addition to the effects (1) to (7) according to the first embodiment.

(8) During the period from the start of the ejection of ink to the printing area A to the end of the ejection of ink to the entire printing area A, the platen 27 is moved relative to the continuous sheet 12. As a result, the boundary between the contact region B and the non-contact region C of the continuous sheet 12 respectively supported by the high temperature region and the low temperature region is changed, and it is possible to disperse the partial concentration of a coloring component in the vicinity of the boundary with the dry of ink.

(9) Since the platen 27 is moved relative to the continuous sheet 12, there is no change in the positional relationship between the continuous sheet 12 and the carriage 30. Therefore, it is not necessary to change an ink ejection position according to the relative movement between the platen 27 and the continuous sheet 12, and it is possible to simplify a control operation.

The above-described embodiments may be modified as follows.

In the above-described embodiments, while the fans 46 are being operated, the platen 27 and the continuous sheet 12 may be moved relative to each other. In addition, the platen 27 and the continuous sheet 12 may be moved relative to each other, while the fans 46 are rotated with low suction power.

In the above-described embodiments, the suction holes 44 and the fans 46 may not be provided. In this case, the heaters 48, 49, and 50 may be irregularly arranged, or the gaps between the first heating portions 52 and the second heating portions 53 may be increased, such that a region of the upper surface of the platen 27 close to the heating portions 52 and 53 serves as the high temperature region and a region thereof that is far away from the heating portions serves as the low temperature region. In addition, a platen 27 having different heat distribution regions may be formed using members having different heat conductivities.

In the above-described embodiments, the movement distance D of the continuous sheet 12 and the platen 27 in the relative movement direction may be more than the diameter of the suction hole 44, which is the low temperature region. In this case, it is also possible to prevent the partial concentration of a coloring component in the vicinity of the non-contact region C by moving the platen 27 and the continuous sheet 12 relative to each other, during the period from the start of the ejection of ink to the printing area A to the end of the ejection of ink to the entire printing area A. That is, it is possible to reduce the occurrence of shading in each region of the continuous sheet 12 disposed on the low temperature region whenever the platen and the continuous sheet are moved relative to each other.

In the above-described embodiments, the printing area A may be out of the upper surface of the platen 27 when the platen 27 and the continuous sheet 12 are moved relative to each other. In this case, it is preferable that a region of the continuous sheet to which ink is completely ejected be disposed outside the platen 27. That is, the recording head 31 ejects ink while the continuous sheet 12 or the platen 27 is moved from the downstream side in the relative movement direction therebetween in a direction that is orthogonal to the relative movement direction. In this way, printing is performed on the entire printing area A. In this case, when the platen 27 and the continuous sheet 12 are moved relative to each other, a region of the continuous sheet on which printing has already been performed is disposed outside the upper surface of the platen 27 after the relative movement.

In the first embodiments a moving unit that moves the continuous sheet 12 in the front-rear direction and the left-right direction may be separately provided. In the second embodiment, the platen 27 may be moved in the left-right direction with the driving of the motor. In addition, the moving unit may move the continuous sheet 12 and the platen 27 in the front-rear direction and the left-right direction.

In the above-described embodiments, while the recording head 31 ejects ink to the printing area A, the platen 27 and the continuous sheet 12 may be moved relative to each other.

In the above-described embodiments, both the platen 27 and the continuous sheet 12 may be moved relative to each other.

In the above-described embodiments, the carriage 30 may pass through the same region of the printing area A a plurality of times while the recording head 31 ejects ink. In this case, the amount of ink ejected by one passage is a value obtained by dividing the amount of ink required for ejection by the number of passages. Therefore, the amount of ink ejected by one passage is reduced, and the number of regions of the continuous sheet 12 to which ink having fluidity is continuously ejected is reduced. Therefore, the flow of ink from the non-contact region C to the contact region B is prevented. In addition, it is possible to change the flow direction of ink that is continuously ejected to be different from the flow direction of the previously ejected ink by ejecting ink to the continuous sheet 12 while changing regions of the continuous sheet disposed on the low temperature region and the high temperature region. Further, after a small amount of ink ejected to a region of the continuous sheet disposed on the contact region B is dried to loss its fluidity, the region of the continuous sheet is disposed on the low temperature region. Therefore, ink that is ejected later does not flow. As a result, it is possible to prevent the flow of ink to the contact region B.

In the above-described embodiments, the ink jet printer 11 is given as an example of the recording apparatus, but the invention is not limited thereto. The invention may also be applied to other liquid ejecting apparatuses (one kind of recording apparatus) that eject liquid materials (which include a liquid material having particles of a functional material dispersed therein) other than ink. For example, the invention may be applied to a liquid ejecting apparatus that ejects a liquid material having dispersed or dissolved therein an electrode material or a coloring material used to manufacture, for example, a liquid crystal display, an EL (electron-luminescent) display, and a field emission display, a liquid ejecting apparatus that ejects a bio-organic material used to manufacture a bio-chip, and a liquid ejecting apparatus that ejects liquid, which is a sample, and that is used as a precision pipette. The recording apparatus may be applied to any one of these liquid ejecting apparatuses.

In the above-described embodiments, the ink jet printer 11 is given as an example of the recording apparatus, but the invention may also be applied to other liquid ejecting apparatuses that discharge or eject liquid materials other than ink. The invention may applied to various kinds of liquid ejecting apparatuses including, for example, liquid ejecting heads that discharge a very small amount of liquid droplet. The liquid droplet means the state of liquid ejected from the liquid ejecting apparatus, and includes a granular liquid, a tear-shaped liquid, and a thread-shaped liquid linking the tails of droplets. In addition, any material may be used as the liquid material as long as it can be ejected from a liquid ejecting apparatus. For example, any liquid material may be used, and examples of the liquid material include a liquid material having high or low viscosity, sol, gel water, fluid materials, such as an inorganic solvent, an organic solvent, liquid, a liquid resin, and liquid metal (metal melt), and a material having particles of a functional material made of, for example, a solid, such as metal particles or a pigment, dissolved or dispersed in, or mixed with a solvent, in addition to the liquid material. For example, as described above, ink or liquid crystal may be given as a representative example of the liquid. The term 'ink' includes various kinds of liquid compositions, such as general aqueous ink and oil-based ink, gel ink, and hot melt ink. For example, the invention can be applied to the following liquid ejecting apparatuses: a liquid ejecting apparatus that ejects a liquid material having an electrode material or a color material, which is used to manufacture a liquid crystal display, an EL (electro-luminescent) display, and a surface-emission display, dispersed or dissolved therein; a liquid ejecting apparatus that ejects a bio-organic material used to manufacture a bio-chip; a liquid ejecting apparatus that ejects a liquid material, which is a test sample used as a precise pipette; a liquid ejecting apparatus that ejects a lubricant to precise machines, such as watches and cameras, in a pinpoint manner; a liquid ejecting apparatus that ejects onto a substrate a transparent resin liquid, such as an ultraviolet-curable resin, to form a minute hemispherical lens (optical lens) that is used for, for example, an optical communication element; and a liquid ejecting apparatus that ejects an acid or alkali etchant to etch, for example, a substrate. The invention can be applied to any one of these liquid ejecting apparatuses.

What is claimed is:

1. A recording apparatus comprising:

a supporting member that has a supporting surface for supporting a target to which a liquid is ejected;

a heating apparatus that heats the supporting member;

a transport unit that transports the target from an upstream side of the supporting member to a downstream side while sliding the target on the supporting surface; and a recording unit that, when a direction in which the target supported on the supporting surface is transported is a main scanning direction, repeatedly performs a moving operation in the main scanning direction in which the liquid is ejected to a recording area of the target to perform recording and a moving operation in a sub-scanning direction in which no liquid is ejected, thereby performing recording on the recording area of the target, wherein, when the supporting member is heated by the heating apparatus, the supporting member includes a high temperature region having a relatively high temperature and a low temperature region having a relatively low temperature in the supporting surface, the transport unit transports the target that is supported on the supporting surface so as to be laid across the high temperature region and the low temperature region at least one time during a period from the start of the ejection of the liquid to the recording area to the end of the ejection of the liquid to the entire recording area by the recording unit, and a movement distance of the target transported by one transport operation is less than the width of the low temperature region in the transport direction.

2. A recording method comprising:

heating a supporting member having a supporting surface which supports a target to which a liquid is ejected while the target is transported from an upstream side to a downstream side in a transport direction and on which the target slides so as to have a high temperature region having a relatively high temperature and a low temperature region having a relatively low temperature in the supporting surface;

allowing a recording unit to repeatedly perform a moving operation in a main scanning direction, which is the transport direction, in which the liquid is ejected to a recording area of the target to perform recording and a moving operation in a sub-scanning direction in which no liquid is ejected, with the recording area of the target being supported by the supporting surface so as to be laid across the high temperature region and the low temperature region, thereby performing recording on the recording area of the target; and transporting the target during a period from the start of the ejection of the liquid to the recording area to the end of the ejection of the liquid to the entire recording area.

* * * * *